US005193515A

United States Patent [19]

Oota et al.

[11] Patent Number: 5,193,515

[45] Date of Patent: Mar. 16, 1993

[54] IGNITION SYSTEM FOR AN ENGINE

[75] Inventors: Nobuyuki Oota, Kariya; Yasutoshi Yamada, Chita, both of Japan

[73] Assignee: Aisin Seiki Kabushiki Kaisha, Kariya, Japan

[21] Appl. No.: 851,001

[22] Filed: Mar. 12, 1992

[30] Foreign Application Priority Data

Mar. 12, 1991 [JP] Japan ..... 3-70306

[51] Int. Cl.[5] ..... F02P 15/08; F02P 3/08

[52] U.S. Cl. ..... 123/637; 123/604; 123/640; 123/620

[58] Field of Search ..... 123/606, 620, 636, 637, 123/640, 604, 655

[56] References Cited

U.S. PATENT DOCUMENTS

| | | | |
|---|---|---|---|
| 3,280,809 | 10/1966 | Issler | 123/637 X |
| 3,919,993 | 11/1975 | Neuman | 123/655 X |
| 4,356,807 | 11/1982 | Tokura et al. | 123/637 X |
| 4,462,380 | 7/1984 | Asik | 123/640 X |
| 4,839,772 | 6/1989 | Choi et al. | 123/604 X |
| 4,967,718 | 11/1990 | Scarnera | 123/604 X |
| 5,044,348 | 9/1991 | Ookawa | 123/637 |
| 5,097,815 | 3/1992 | Oota et al. | 123/606 |
| 5,140,970 | 8/1992 | Akaki et al. | 123/620 |

FOREIGN PATENT DOCUMENTS

| | | | |
|---|---|---|---|
| 0050273 | 3/1985 | Japan | 123/640 |
| 1-116281 | 5/1989 | Japan . | |
| 2087483 | 5/1982 | United Kingdom | 123/640 |

*Primary Examiner*—Willis R. Wolfe

*Attorney, Agent, or Firm*—Oblon, Spivak, McClelland, Maier & Neustadt

[57] ABSTRACT

An ignition system for two ignition current circuits including a condenser to supply the ignition current to the plug. The ignition current circuits provide the ignition current to the plug alternately in response to an ignition timing signal so that the first and second current circuit to supply the ignition current constantly.

2 Claims, 4 Drawing Sheets

IGNITION SYSTEM FOR AN ENGINE

BACKGROUND OF THE INVENTION

1. Field of the Invention

The present invention relates to an ignition system for an automobile engine.

2. Description of the Prior Art

A conventional multi-ignition system supplies ignition currents to the ignition plug many times in a certain period of time in which responds to an ignition timing signal. This prevents the ignition from misfire and knocking by applying a high voltage power many times. This kind of multi-ignition system uses an ignition condenser placed between the power supply and the ignition coil. The condenser supplies a power energy to the ignition coil. FIG. 4 is a circuit diagram of an ignition system shown in Japanese Patent Laid-Open Hei 1-116281 (1989). Referring to FIG. 4, an engine computer CPU sends an ignition timing signal out to a control circuit 112. A oscillator 206 turns on and off the charge circuit 100 in response to an ignition timing signal to charge an ignition condenser 101. The oscillator 206 also controls a transistor 107 to discharge the condenser 101 through an ignition coil 102. This discharge energy of the ignition coil 102 provides the energy to spark the plug 103. When the condenser 101 discharges, the discharge current from the condenser 101 through the choke coil 128 and the coil 102 increases in accordance with a frequency of the circuit. The discharge current becomes the maximum when a charge of the condenser 101 becomes zero. At the same time a magnetic energy stored in the coil 102 and the choke coil 128 also becomes the maximum. This magnetic energy turns on the first diode of the second current circuit 110 to keep supplying the ignition energy to the ignition plug. The primary current of the coil 102 decreases as the ignition plug 103 consumes the ignition energy. When the primary current becomes too low to supply the ignition energy to the ignition plug 103, the transistor 107 turns off. The Zener diode 129 of the first current circuit 205 turns on to draw the current of the primary coil of the coil 102. Thus the energy in the coil 102 discharges through the first current circuit 205. The charge and discharge of the condenser 101 which provides the plug with the ignition energy repeats many times in one ignition timing signal.

This type of the ignition system can provide a higher energy by the condenser which repeats a charge and a discharge repeatedly. The system, however, requires a time to charge the condenser during the ignition timing. Spark break which is a time period between two sparks is a fairly long time of period because of a charging time of the condenser.

A spark of the plug may not be sufficient to burn the fuel continuously and causes a misfire. If a misfire occurs during a time of charging a condenser, the fuel remains unburnt until the plug sparks in a next time. This may result a higher tail pipe emission and a lower driving ability.

SUMMARY OF THE INVENTION

Accordingly, one of the objects of the present invention is to produce an ignition system to obviate the above drawbacks.

Another object of the present invention is to produce an ignition system which can prevent a misfire so that the system can provide a better fuel efficiency and a better driving condition.

To achieve the above objects, and in accordance with the principles of the invention as embodied and broadly described herein, an ignition system for an automobile comprises an ignition plug, ignition timing means for providing an ignition timing signal, the first ignition current supply means connected to the ignition plug includes coil means having a primary coil connected to the ignition plug, a condenser, charge means for charging the condenser, switching means for discharging the condenser, the second ignition current supply means connected to the ignition plug includes coil means having a primary coil connected to the ignition plug, a condenser, charge means for charging the condenser, switching means for discharging the condenser, and switching control means for switching said first and second current supply means alternately in response to said ignition timing signal.

In accordance with the above mentioned ignition system, the system supplies an ignition current to the plug by the first and second ignition current supply means which are switched alternately. One ignition current supply means can supply an ignition current to the plug while the other ignition current supply means is charged. This system can eliminate or minimize a brake time to charge the condenser. Thus a misfire can be recovered by a next ignition current supplied immediately after the previous ignition current.

BRIEF DESCRIPTION OF THE DRAWING

For a full understanding of the true scope of the invention, the following detailed description should be read in conjunction with the drawing, wherein.

DETAILED DESCRIPTION OF THE PREFERRED EMBODIMENTS

In the following, preferred embodiments of the present invention will be described with reference to the drawings.

Figure 1:
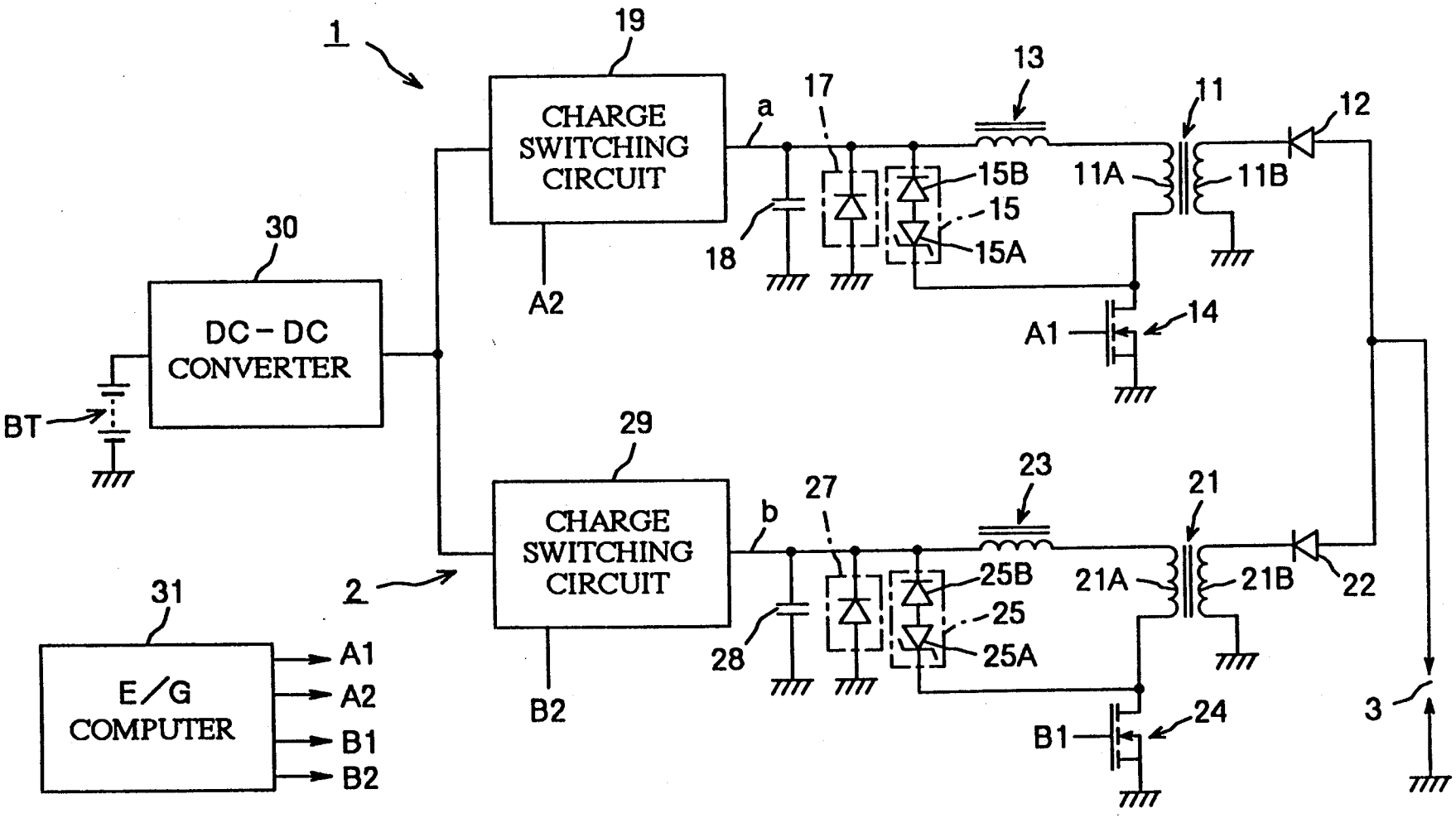
FIG. 1 is a block diagram which shows a circuit of an ignition system of the present invention.

FIG. 1 shows a block diagram of an ignition system of the present invention.

Referring to FIG. 1, the ignition system has the first current supply circuit 1 and the second current supply circuit 2. The first and second current supply circuits comprise the same circuits. The secondary coils 11B, 21B of the ignition coils 11, 21 are connected to the ignition plug 3 so that the each coils can supply the ignition current to the plug independently. The current supply circuits 1, 2 have enhancement type MOSS transistors 14, 24. The sources and the drains of the transistors 14, 24 are connected to the condensers 18, 28, the choke coils 13, 23, the primary coils 11A, 21A of the ignition coils 11, 21. The gates of the transistors 14, 24 are connected to an engine control computer 31 to receive the switching signals A1, B1.

The condensers 18, 28 are connected to DC-DC converter 30 through the charge switching circuits 19, 29. DC-DC converter 30 is connected to the battery BT. The charge switching circuits 19, 29 receives the switching signals A2, B2 from the engine control computer 31 to supply the power to the condensers 18, 28. The switching signals A1 and B1 and the switching signals A2 and B2 are the complementary signals, respectively.

Zener diodes 15A, 25A of the first current circuits 15, 25 are connected in series to the first diodes 15B, 25B, respectively. The first current circuits 15, 25 are connected to the primary coils 11A, 21A of the ignition coils 11, 21 through the choke coils 13, 23, respectively. The second diodes 17, 27 are connected in parallel to the condenser 18. The cathodes of the diodes 17, 27 are connected to the lines a, b in FIG. 1.

Figure 2:
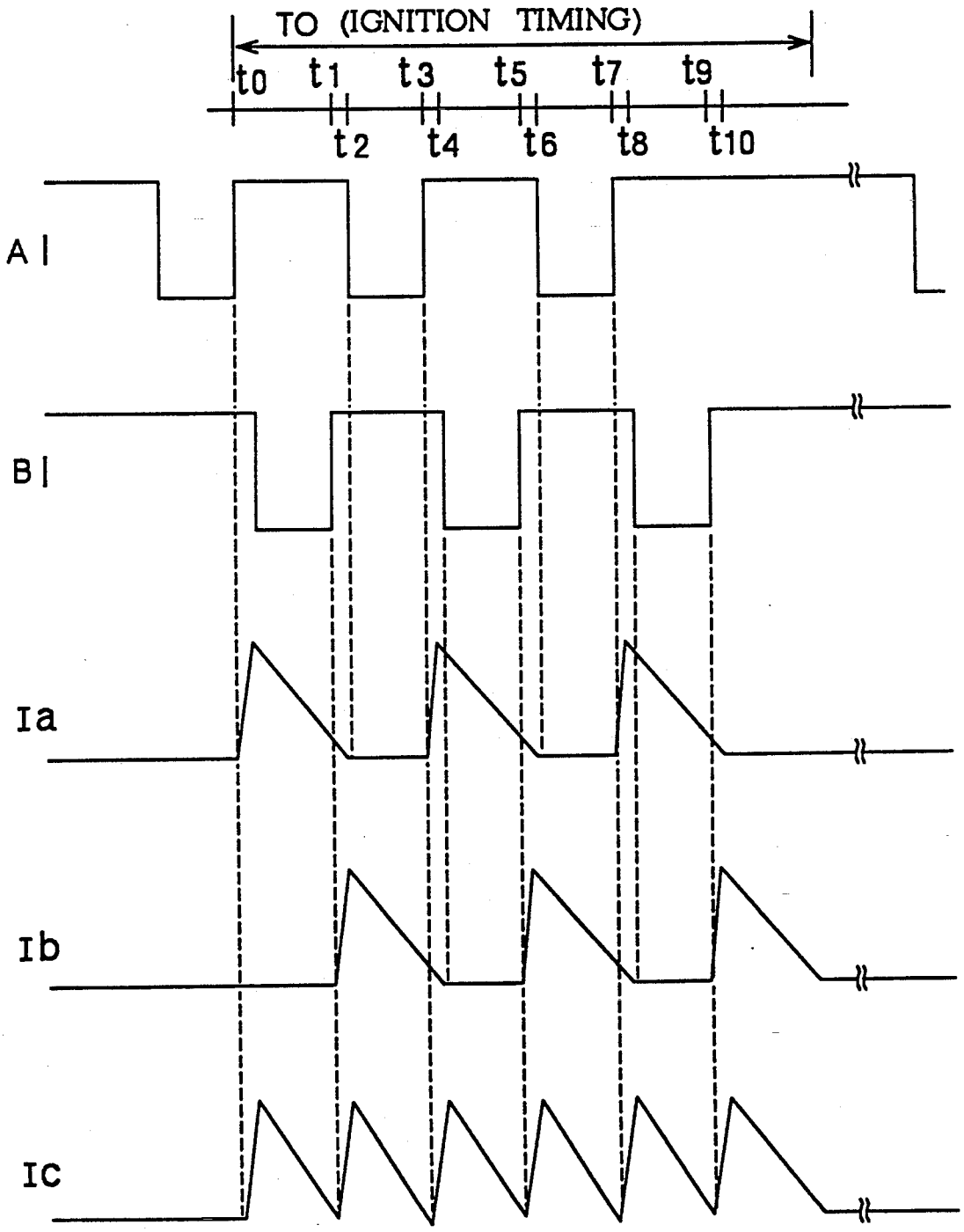
FIG. 2 is a timing chart which shows signals of the circuit of the present invention.

FIG. 2 is a timing chart which shows the operation of the present invention. Referring to FIG. 2, the switching signal A1 to control the first current circuit 1 and the switching signal B1 to control the second current circuit 2 are the same shape but the polarities are the opposite as shown in FIG. 2. During the one ignition timing signal $T_0$, the switching signals A1, B1 switches three times to be "H" level. "H" level indicates the period in which the ignition plug is in its operation. "L" level indicates the period in which the ignition plug rests. As shown in FIG. 2, the period of operation is longer than the period of rest. At the time $t_0$ when the ignition timing signal occurs, the switching signal A1 becomes "H" level and the transistor 14 turns on. The transistor 14 discharges the condenser 18 through the choke coil 13 and the primary coil 11A of the ignition coil 11. The secondary current Ia is generated in the secondary coil of the ignition coil 11 to cause the ignition current Ic.

LC resonance circuit comprises of the ignition condenser 18, the choke coil 13 and the primary coil of the ignition coil 11. The secondary current Ia and the ignition current Ic rise in accordance with the LC resonance circuit. When the ignition current Ic becomes the maximum, the electric charge of the condenser 18 becomes zero. The primary current of the ignition coil 11 supplied by the choke coil 13 and the coil 11 goes to the second diode 17 bypassing the ignition condenser 17. At the time of $T_1$ when the currents Ia and Ic is about to become zero, the switching signal B1 of the control computer 31 becomes "H" level to turn the transistor 24 of the second current circuit 2. The electric charge of the condenser 28 discharges through the primary coil 21A of the coil 21 and the choke coil 23. Both of the secondary coils 11B, 21B of the coils 11, 21 supply the ignition current to the ignition plug 3 so that the ignition current Ic rises again before the ignition current Ic becomes zero. At the time of $T_2$ the switching signal A1 becomes "L" level, the transistor 14 of the first current circuit 1 turns off to release the primary current caused by the magnetic energy in the ignition coil 11. On the other hand, the switching signal A2 becomes "H" level to turn on the charge switching circuit 19. The condenser 18 starts charging again.

The charge and discharge of the condensers 18, 28 are repeated in three times in the first and second current circuit 1, 2, respectively. The current Ic goes through the ignition plug 3 does not become zero. This recovers the misfire.

Figure 3:
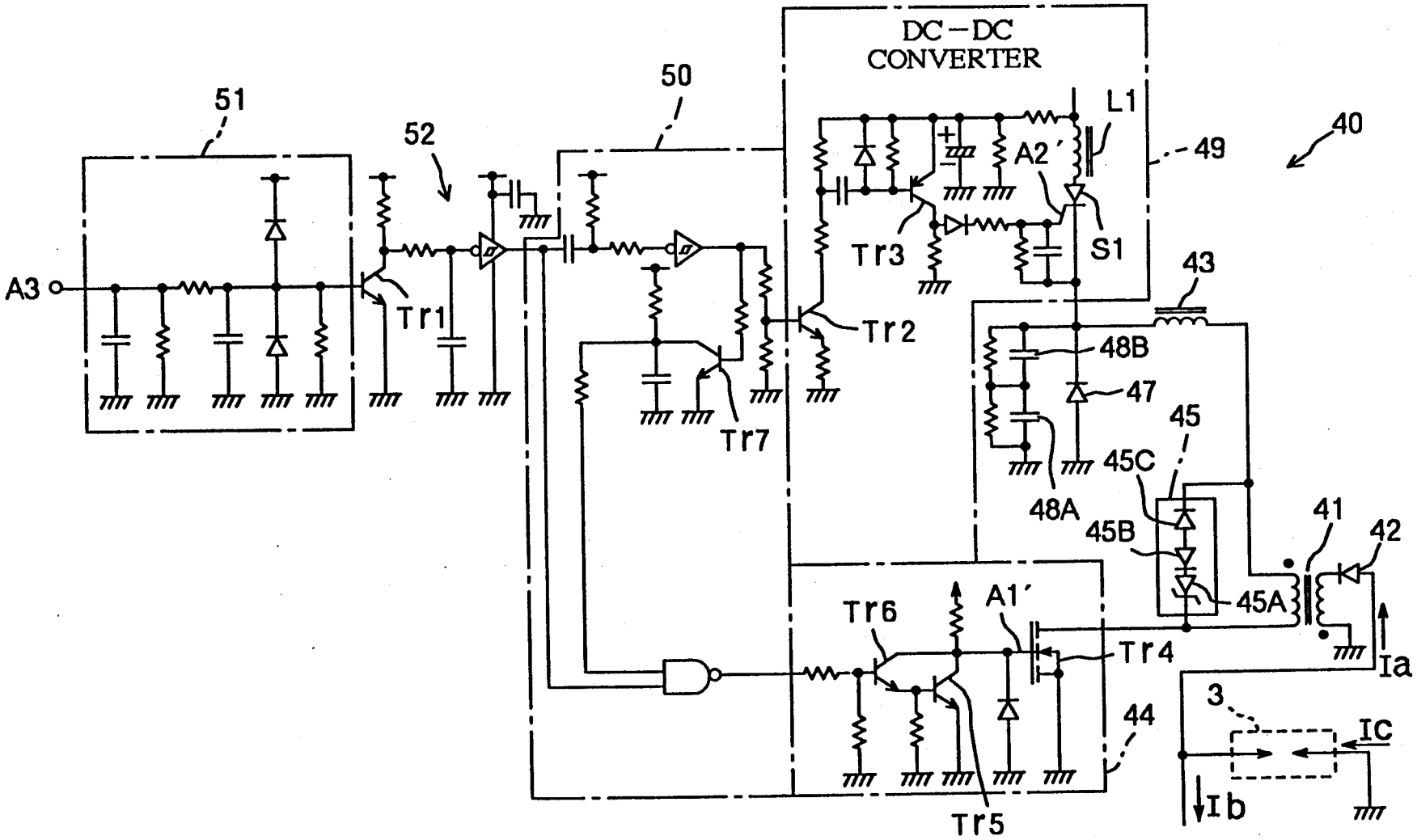
FIG. 3 is a block diagram which shows a circuit of another ignition system of the present invention.
Figure 4:
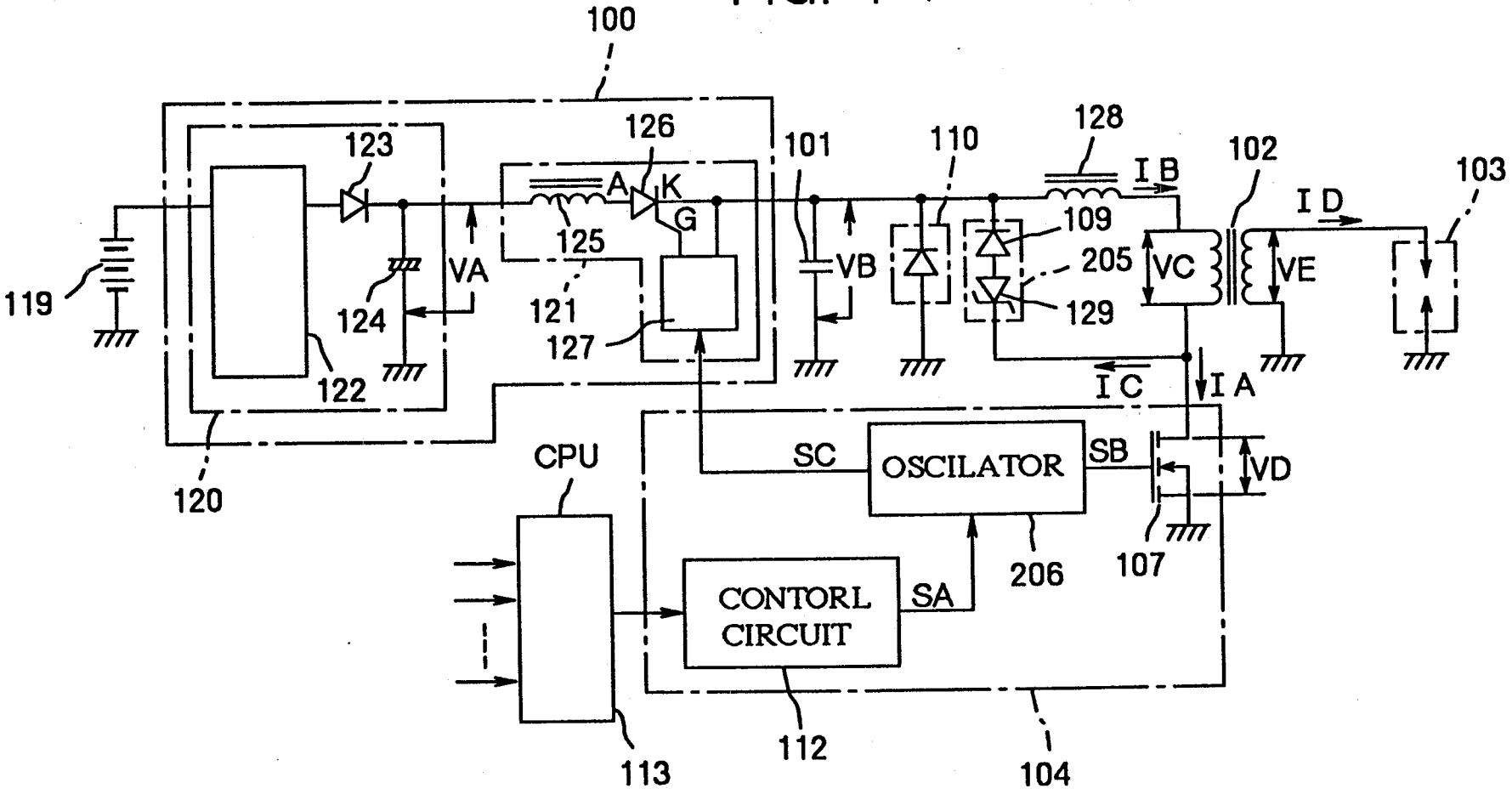
FIG. 4 (PRIOR ART)
FIG. 4 is a block diagram which shows a circuit of a conventional ignition system.

FIG. 3 is a block diagram which shows a circuit of another ignition system of the present invention. The explanations to the parts correspond with the first embodiment of the present invention. Only one of the current circuit 40 is shown the details in FIG. 3. When the ignition timing signal A3 is input, the signal is transferred to the timer circuit 50 through the filter 51 and the integral circuit 52. The time is set in response to the ignition timing signal A3. The timer circuit 50 sends the signal to the charge circuit 49 and the discharge switching circuit 44, alternately. The charge circuit 49 has a reactance L1 which is connected to DC-DC converter. The reactance L1 converts 200 volt power from the DC-DC converter into 400 volt power to charge the condensers 48A, 48B. The first current circuit 45 has series connected diodes 45A, 45B and a diode 45C.

An engine revolution, throttle angle and a burn condition of the fuel detected by a burn sensor, ion sensor or a pressure sensor are the part of the engine condition signals. When the burn sensor detects the burn of the fuel in the combustion chamber, the signal A3 changes the timing signal into "L" level to set a rest.

The control signal A3 sent by the computer sets the charge and the discharge time of the condenser. The computer also sets the period of the operation and rest in accordance with the engine condition. When the burn of the fuel is detected, the computer sends the signal to stop supplying the ignition current to save energy.

In the above mentioned embodiments, the choke coil are placed with the primary coil of the ignition coil. If the reactance of the ignition coil is big enough, the choke coil may not be necessary.

The invention has been described in an illustrative manner, and it is to be understood that the terminology which has been used in intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. An ignition system for an automobile comprising:
an ignition plug;
ignition timing means for providing an ignition timing signal;
a first ignition current supply means connected to said ignition plug including;
coil means having a primary coil connected to said ignition plug;
a condenser;
charge means for charging said condenser;
switching means for discharging said condenser;
a second ignition current supply means connected to said ignition plug including;
coil means having a primary coil connected to said ignition plug;
a condenser;
charge means for charging said condenser;
switching means for discharging said condenser; and
switching control means for switching said first and second current supply means alternately in response to said ignition timing signal.

2. An apparatus according to claim 1, wherein said first and second ignition current supply means further including, respectively;
a first current circuit for releasing a magnetic energy in said coil means when said switching means turns off; and
a second current circuit for releasing a magnetic energy in said coil means bypassing said condenser when said switching means turns on.

* * * * *